US010233800B2

(12) United States Patent
Gruber

(10) Patent No.: US 10,233,800 B2
(45) Date of Patent: Mar. 19, 2019

(54) METHOD FOR OPERATING A COMBUSTION ENGINE

(71) Applicant: IFT GMBH, Uderns (AT)

(72) Inventor: Christoph Gruber, Hippach (AT)

(73) Assignee: IFT GMBH, Uderns (AT)

( * ) Notice: Subject to any disclaimer, the term of this patent is extended or adjusted under 35 U.S.C. 154(b) by 130 days.

(21) Appl. No.: 15/189,832

(22) Filed: Jun. 22, 2016

(65) Prior Publication Data

US 2016/0376948 A1 Dec. 29, 2016

(30) Foreign Application Priority Data

Jun. 24, 2015 (AT) ..... 50545/2015

(51) Int. Cl.

| | |
|---|---|
| ***F01M 11/06*** | (2006.01) |
| ***F01M 13/04*** | (2006.01) |
| *F01M 13/00* | (2006.01) |
| *F01M 11/04* | (2006.01) |

(52) U.S. Cl.

CPC ..... *F01M 11/061* (2013.01); *F01M 13/04* (2013.01); *F01M 2011/0466* (2013.01); *F01M 2013/0038* (2013.01)

(58) Field of Classification Search

CPC ..... F01M 11/061; F01M 11/06; F01M 13/00; F01M 13/0038; F01M 13/04; F01M 2013/0422; F01M 2013/0433

See application file for complete search history.

(56) References Cited

U.S. PATENT DOCUMENTS

| | | | | |
|---|---|---|---|---|
| 2009/0139484 A1* | 6/2009 | Harris | ..... | F01M 11/0458 123/196 S |
| 2012/0006306 A1* | 1/2012 | Boehm | ..... | F01M 13/0011 123/572 |

FOREIGN PATENT DOCUMENTS

| | | |
|---|---|---|
| DE | 540910 | 12/1931 |
| DE | 19902928 | 8/2000 |
| DE | 10118454 | 10/2002 |
| EP | 2767578 | 8/2014 |

OTHER PUBLICATIONS

Austrian Search Report for Austrian Application No. A50545/2015 dated Jan. 15, 2016.

* cited by examiner

*Primary Examiner* — Jacob Amick
(74) *Attorney, Agent, or Firm* — Workman Nydegger

(57) ABSTRACT

A method for operating a combustion engine having a crankcase, a piston group and a crankshaft, wherein the crankcase has an oil reservoir and an operational amount of lubricating oil is provided, wherein i) a partial amount of the lubricating oil is continuously discharged from the crankshaft and ii) a refill amount of new lubricating oil is continuously supplied, so that the operational amount of lubricating oil remains essentially the same; as well as a combustion engine for carrying out the method.

8 Claims, 2 Drawing Sheets

METHOD FOR OPERATING A COMBUSTION ENGINE

The invention relates to a method for operating a combustion engine having a crankcase, a piston group and a crankshaft, wherein the crankcase has an oil reservoir and an operational amount of lubricating oil is provided. The invention also relates to a stationary combustion engine, comprising a crankcase having a piston group, a crankshaft and an oil sump.

PRIOR ART

With combustion engines having a long downtime, the operational costs constitute an essential parameter influencing the cost effectiveness of the plant. In particular with stationarily operated combustion engines having pistons, the costs of the lubricating oil, in turn, represent a significant portion thereof.

For the lubrication of such combustion engines, there is provided an oil reservoir, which is situated, e.g., in the oil sump in the lower part of the piston housing. In this case, this is called, e.g., wet sump lubrication. The lubricating oil is circulating in the engine: starting from the oil reservoir in the oil sump, the oil is sucked in by the oil pump and then pumped into the oil filter; from there it reaches the oil cooler. Subsequently, the oil tube ramifies. A part of the oil is moved to the various bearing lubricating positions, another part is injected at the bottom side of the pistons, which provides for, on the one side cooling of the pistons and, on the other side for oil wetting of the cylinder sleeves.

In operation of the combustion engine, leakage gases, so called blow-by gases, enter the crankcase via the ring sealing of the piston rings, which are interfused with small oil particles. Together with the splash oil, there is formed around the crankshaft a gas mixture loaded with oil drops. In order to prevent a pressure increase in the crankcase caused by the blow-by gases, venting is necessary. It has been known that, in this way, oil will also be discharged.

With stationary combustion engines, there is occasionally used an open crankcase venting, wherein the blow-by gases are discharged from the crankcase into the environment. For reasons of environmental protection, however, an oil separator has to be installed downstream of the outlet opening for the blow-by gas, thus requiring a suction blower. As an alternative, there have been known closed systems for the crankcase venting, which are in particular used with automobiles. In these systems, the blow-by gases are returned, i.e. re-directed into the suction duct of the engine. An air inlet in the crankcase (e.g., known from DE 540910) supports the exhaustion of the blow-by gas, enabling a circulation with return of the gases into the combustion chamber. Herein, there is especially required the oil separation from the blow-by gas in order to prevent contamination of the suction system that is caused by oil particles. For this reason, in closed systems there is installed an oil separator upstream the return of the gas portion, with the lubricating oil separated being again directed from the oil separator back to the oil reservoir. For a closed crankcase venting, hence, this will result in a lower oil consumption in comparison with open systems.

Generally speaking, in the course of the engine operation the quality of the lubricating oil will decline. For this reason, oil changes have to be performed on a regular basis, for example at fixed points of time or depending on the oil condition, which is determined by periodically performed oil analyses. For the assessment or quantification, respectively, of the lubricating oil characteristics, there have been defined certain criteria and parameters on an international level, for which there are determined specific measurement methods and mostly varying threshold values by the engine manufacturers. The most important quality criteria or lubricating oil characteristics are viscosity, total base number (TBN), total acid number (TAN), oxidation and nitration. If one of the lubricating oil parameters reaches or exceeds the threshold value respectively determined, the lubricating oil has to be replaced by fresh oil in the course of the oil change.

In general, with combustion engines having rotary lubrication, applies that, apart from the costs for the lubricating oil itself, also associated costs will arise. The costs for the lubricating oil balance, hence, are comprised by the oil consumption (which is to be supplemented constantly), the amount of fresh oil arising from oil changes, the downtime of the engine for performing the oil change, the labour time required therefore, the oil logistics, including the disposal of the waste oil, as well as the oil analyses that are to be carried out periodically.

Depending on the application and the frame conditions, the costs for the lubricating oil may amount to about 15-20% of the overall costs for service and maintenance (including major overhaul). The oil consumption of the engine further determines the oil replenish rate due to automatic lubricating oil refill, which is why an increased oil consumption in general will also lead to a higher oil service life. With modern high-performance engines, the specific lubricating oil consumption amounts to about 0.15 g/kWh, and the engine oils will reach a service life between 1,000 and 3,000 hours of operation. The costs of lubricating oil consumption and oil change are more or less in the same range.

BRIEF DESCRIPTION OF THE INVENTION

It is, hence, an object of the present invention to provide a method for operating a combustion engine and such a combustion engine, wherein the lubricating oil consumption is reduced and/or the oil change may be omitted or the interval for the oil change may be increased, respectively.

The task is solved in the invention described herein by a method for operating a combustion engine having a crankcase, a piston group and a crankshaft, wherein the crankcase has an oil reservoir and an operational amount of lubricating oil is provided, which method is characterized in that i) a partial amount of the lubricating oil is continuously discharged from the crankshaft and ii) a refill amount of new lubricating oil is continuously supplied, so that the operational amount of lubricating oil remains essentially the same.

By continuously replacing a sufficient partial amount of lubricating oil, there is not required an oil change associated with downtime. The partial amount that is discharged is thereby replaced by fresh oil, so that the quality of the operational amount serving for lubricating the engine, hence, will be permanently kept in a usable condition. How the discharge of such a partial amount is realized, will be shown in subsequent embodiment variants. The required refill amount from the fresh oil container to the operational amount in the combustion engine may be controlled, for example, so that it will depend on the filling level of the oil reservoir, e.g., of the oil sump, being controlled by a proportioning device. The advantages resulting in particular in the field of stationary combustion engines are significant due to the omission of downtime and maintenance works for the oil change.

Moreover, there may also be realized saving potential by a lower consumption of fresh lubricating oil. In principle, the more lubricating oil is discharged in the inventive method, the better is the quality of the operational amount of lubricating oil, as the amount discharged will be replaced by fresh oil. The inventive method will become especially cost-efficient if the partial amount of the discharged oil has a lower quality than the remaining lubricating oil, which is circulating in the crankcase. The invention disclosed herein is based on the finding that the oil quality is non-uniformly distributed in the crankcase. Preferably, also the partial amount discharged is selected such that the oil of this partial amount already shows reduced quality. Basically, temperature, chemical environment and surface effects are relevant for the ageing rate, thus determining the quality of the oil.

The oil fraction that is subjected to the highest strain and thus the strongest ageing mechanism is that oil fraction that is exposed to the highest temperatures as well as the chemically reactive glow-by gases in the most intensive way, i.e. that fraction, which provides for lubrication and cooling of the piston group. This part of the lubricating oil is significantly more degraded than the oil, which returns from the deposits in the oil sump. Due to the engine components moved at relative high velocities and the high exit rate of the oil from the cooling oil jets, the oil in the crankcase will disintegrate into an oil mist having a wide spectrum of drop diameters. Due to the development mechanism and the proportionally large surface area, the oil droplets are, hence, more degraded the smaller the size thereof is.

In an embodiment variant, the partial amount of the discharged lubricating oil is selected such that the lubricating oil is provided in a usable condition in overall, but at least one quality parameter will be ranged near the acceptable tolerance range, wherein the quality parameter is selected from the group consisting of viscosity, total base number (TBN), total acid number (TAN), oxidation and nitration, and the determined tolerance range is defined depending on the quality parameter, and wherein the partial amount that is discharged, in at least one quality parameter, has a lower quality than the lubricating oil of the operational amount.

The maximum efficiency is reached for the inventive method only when for the operational amount of the lubricating oil in at least one quality parameter the tolerance range of the quality parameter is met only slightly, and when this quality condition of the oil is kept throughout the operational time of the combustion engine. In this way there is prevented that a notable amount of usable oil is discharged from the engine. The refill amount is minimized. If the quality of the operational amount is only slightly above the limit of usability (i.e. near the limits of the tolerance range of a quality parameter), then there will be prevented that oil still usable is discharged and unnecessarily disposed of. This in particular because the oil discharged from the combustion engine has a lower quality than the oil of the operational amount of the combustion engine.

The level at which the oil quality parameters will stabilize is, among others, dependent on the replenish rate due to the supply of fresh oil. In order to reach stabilization near the acceptable oil threshold values, in the application of the proposed method there is required over the service life of the engine an oil discharge of about 25-35% of that amount of oil, which would accumulate during this period with the regularly performed oil changes. In this way, there is achieved a reduced oil consumption in comparison with the operation including oil changes, even if the consumption may be increased in operation.

In order to control the method according to the invention, it may be advantageous to register at least one quality parameter of the lubricating oil. For this purpose, also individual checks of the oil quality in the oil reservoir may be performed. Also sensors for the continuous monitoring of individual oil parameters will be available.

In an embodiment the method is characterized in that the partial amount of lubricating oil that is continuously discharged is discharged via an airflow. Thereby, fresh air is moved into the crankcase via an inlet, the airflow absorbs oil drops in the gas chamber of the crankcase so that the airflow is loaded with the partial amount of lubricating oil to be discharged and is then moved with the airflow via an outlet out of the crankcase.

In this connection, the airflow may also be designated as purging air. Through the outlet, the airflow entrains an oil load, which is then, as to say, purged out of the crankcase or the crank cavity. The partial amount of oil discharged may be separated from the purging air by means of an oil separator. The oil separator or filter should be connected to a waste oil container, so that the discharged oil may be directly disposed of. By means of this embodiment variant, it was possible to provide a method for operating an engine, wherein the partial amount of the lubricating oil that is removed could be suitably selected in terms of quantity as well as quality, in order to have very advantageous effects on the oil balance of a suitable stationary combustion engine.

In an advantageous embodiment, the method is characterized in that the airflow is moved in the crankcase such that it is deflected about a rotational axis of the crankshaft in the corresponding rotational direction of the crankshaft, wherein preferably the inlet is situated underneath the height of the crankshaft on one side of the crankcase and the outlet is situated above the height of the crankshaft on the same side of the crankcase.

The specific arrangement of inlet and outlet provides for the proportioning of the airflow, wherein a suitable amount as well as also a suitable oil drop fraction is removed in order to achieve the desired quality of the operational amount. The inlet is advantageously adapted so that cool fresh air is blown in at several positions of the crankcase. Also the outlet may be provided along the sidewall of the crankcase in a multi-part way. Due to the arrangement of the inlet underneath the outlet on the same side, the airflow will circulate about the crankshaft. Another advantage of this embodiment is that the surface reactions will be reduced by the flushing of the oil droplets with cool air and thus the ageing rate of the oil (based on the quality of the operational amount) will be reduced.

The oil mist in the crankcase above the oil sump is provided in a drop spectrum, wherein the smallest drops differ from the largest ones by about 5 orders of magnitude. The diameter of the smallest droplets amount to about 0.1 μm, with the largest ones reaching several millimeters. Especially the drop fraction smaller than about 10 μm is mostly from regions in the area of the piston group that are thermally and chemically intensively strained. This fraction, hence, is correspondingly stronger degraded than the oil in the oil sump.

In particular the small oil droplets will be entrained by the airflow to a greater extent than the larger ones so that the oil, which is in this way discharged from the engine, is more degraded than the oil in the oil sump of the engine.

In one aspect the method according to the invention is characterized in that in the oil drop fraction discharged there are predominantly present droplets having a diameter of less than about 0.2 mm, preferably less than about 0.1 mm, preferably less than about 0.01 mm.

By appropriate installations at the outlet for the airflow from the crankshaft, larger droplets may be prevented from exiting, for example by cyclones or deflector plates. By this provision, there is achieved that with the purging air only the more degraded oil fraction will be discharged with the purging air from the combustion engine. Preferably droplets having a diameter of more than 0.2 mm will be retained.

Via the volume of the airflow, the amount of oil drops discharged will be controlled. As already mentioned, the amount of oil discharged determines the quality of the operational amount. Depending on various circumstances and conditions, an oil rate of at least 0.03 and at the most 0.7 should be discharged as a partial amount. The purging air, hence, needs to be able to entrain a suitable appropriate oil load. This will only be possible if the amount of purging air reaches a determined volume flow and if a corresponding concept optimization for the supply and discharge of the purging air is realized.

The volume of the airflow may be controlled by various measures such as throttle devices at the outlet and/or inlet.

In order to ensure the required amount of oil to be discharged, there is further proposed to arrange the outlet and inlet openings so that an excess of oil is present at the exit at the height of the crankshaft, and this excess is reduced by mixing with a part of the crankcase gas, which is removed at a position having an essentially lower oil portion, to the appropriate amount. Suitable positions for a further exit, at which an airflow having a lower oil percentage is removed from the crankcase, are, for example, situated at the upper surface of the crankcase. The gas exiting at the upper and slow-flow end of the crankcase has a significantly lower oil load than the gas that exits laterally, which has been moved via the first outlet.

In an embodiment variant the method according to the invention is characterized in that the airflow discharging the major amount of the oil drop fraction is mixed with a further airflow from the crankcase, wherein the further airflow differs from the loaded airflow by a lower oil load, so that the partial amount of lubricating oil that is discharged from the crankcase will be determined by a mixing ratio of the two airflows.

In contrast to some embodiments of a closed crankcase venting, wherein also the inlet and the outlet are provided in the crankcase, in the method according to the invention a partial amount of the oil entrained in the airflow will be ultimately discharged and not returned to the oil circulation. Moreover, the amount of purging air differs essentially from the amount of air exiting for removing blow-by gases from the crankcase. With stationary combustion engines, the blow-by volume flow amounts to about half of the purging amount according to the invention, for example, about 26 $m^3/h$ in comparison to 50 $m^3/h$. The method according to the invention may, however, advantageously also discharge the blow-by gases.

In an embodiment variant, the method is further characterized in that a gas portion, which flows into the crankcase via the piston group (blow-by gas), is discharged together with the airflow.

In a further aspect the invention relates to a stationary combustion engine, comprising a crankcase having i) a piston group, ii) a crankshaft and iii) an oil sump, characterized in that in the area of the crankshaft there are provided an inlet for an airflow and above the inlet at least one outlet for the airflow, wherein an oil separator is provided downstream of the outlet, which is connected with a waste oil container.

Such a stationary combustion engine essentially has all technical features in order to being operated by a method according to the invention. Those skilled in the art could also be able to transfer the principle of the method optionally also to other installations and apply it to other combustion engines. The combustion engine according to the invention has proven to be useful in the field of the stationary application in order to apply a method according to the invention, wherein the partial amount of the lubricating oil is discharged with the airflow from the crankcase. From the airflow the discharged partial amount is separated by an oil separator or an equivalent suitable measure and retained in a waste oil container ready for subsequent disposal. With stationarily operated combustion engines, the cost fraction for the lubricating oil may amount to about 15-20% of the overall costs for service and maintenance (including major overhaul). Due to the combustion engine according to the invention, there is realized an economically relevant advantage if the engine is operated according to the inventive method.

The oil separator is preferably adapted so that also finest oil drops will be separated. The connection between outlet at the crankcase and oil separator is preferably arranged continuously inclined so that oil mist, which condenses at the external walls, will also be discharged in the direction of the oil separator. Preferred oil separators work according to the principle of parallel flow depth filtering, wherein the filter inlets will not be expended but may rather be used maintenance-free for more than 20,000 hours of operation.

In order to ensure the continuous refilling with the method according to the invention, the combustion engine according to the invention is in one embodiment variant characterized in that a fresh oil container is connected with the oil sump and has a proportioning device.

The proportioning device preferably replaces wasted oil by fresh oil in an automated way. The necessary refill amount may, for example, be determined via the filling level of the oil sump (e.g., by means of a floater).

In a further embodiment variant, the combustion engine is characterized in that the inlet is arranged on a first side of the crankcase at a height between oil sump and crankshaft. In this way, the airflow is directed underneath the crankshaft to the opposite second side of the crankcase. Further, the at least one outlet is preferably arranged on the first side of the crankcase above the inlet. In this way, the airflow is directed around the crankshaft and above the crankshaft back to the first side.

This arrangement of inlet and outlet at the crankcase or crank cavity, respectively, has proven to be advantageous for removing a partial amount of the oil according to the inventive method. Also several inlet or outlet openings, respectively, may be arranged adjacently. For example, several inlets at the same height on the side of the crankcase may enable the entry of air in the direction, in which the longitudinal axis of the crankshaft extends.

Another embodiment provides that the combustion engine is characterized in that a further outlet is arranged in the area of the upper surface of the crankcase.

The further outlet is preferably arranged in an area with slow-flow gas in the crankcase. In this way, a partial air flow is moved via the further outlet, which has a lower oil load than the airflow from the laterally arranged airflow. If the outlet and the further outlet are provided with throttle devices, then the partial amount of the lubricating oil discharged may actively be controlled.

In an embodiment a combustion engine according to the invention is characterized in that respectively one adjustable throttle controls the airflow, which is moved out of the crankcase via the respective outlet.

In a further embodiment a combustion engine according to the invention is characterized in that a first connection moves the airflow from an air suction position of the combustion engine to the inlet in the crankcase and a second connection moves the airflow out of the outlet of a supply air duct of the combustion engine, after having passed the oil separator, wherein at the position, where the supply is realized, there is preferably present in the area of the engine full load a negative pressure preferably between 60 and 110 mbar.

By the two connections, the airflow is integrated in already existing structures of a stationary combustion engine (air suction position, supply air duct). A negative pressure between 60 and 110 mbar is present in a stationary combustion engine under full load, e.g., upstream of the compressor. The negative pressure supports the circulation of the airflow in the crankcase as well as the continuous discharge of the partial amount of lubricating oil. The required volume flow of the airflow may be well reached using the given negative pressure. The operating mode of the oil separator is also ensured by the negative pressure, without requiring a suction blower as an additional component. Blow-by gases are returned advantageously by a further connection into the combustion duct.

Furthermore, in a preferred embodiment the combustion engine according to the invention is characterized in that the outlet at the crankcase is provided with a selecting device.

A selecting device may also be considered as an oil separator, wherein preferably an oil fraction is separated, the droplets of which having a diameter of more than about 0.2 mm. The selecting device prevents that a notable portion of still usable oil will be discharged with the purging air from the engine. Only the oil drop fraction having smaller diameters may pass through the outlet at the crankcase due to the selecting device, which is why the quality of the discharged partial amount will have the worst condition of oil in the crankcase. The selecting device is preferably selected from the group of baffle plates, deflector plates or cyclones.

DETAILED DESCRIPTION OF THE INVENTION

In the following, the method for operating a combustion engine and stationary combustion engines will be illustrated in schematic figures and exemplary embodiments.

Figure 1:
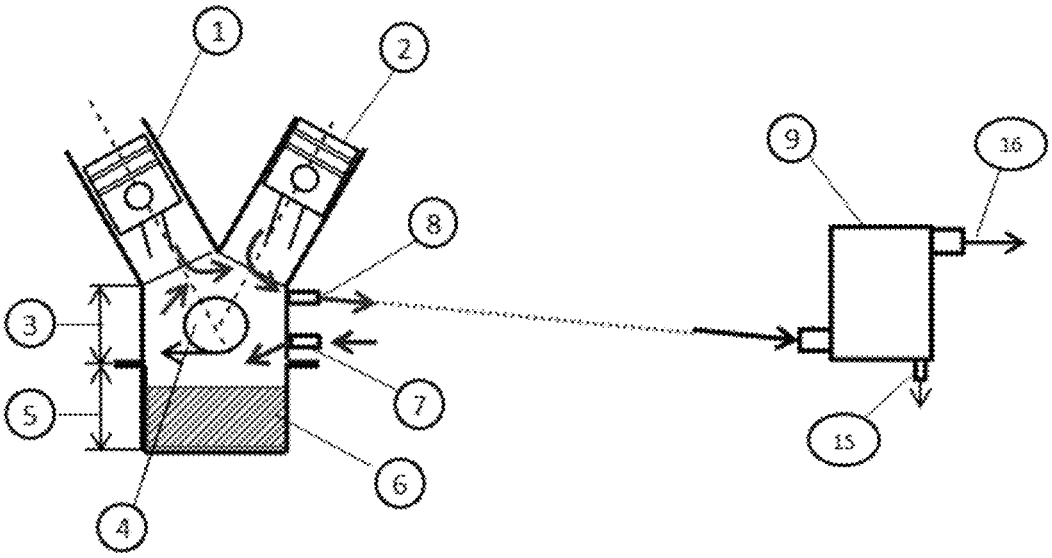
FIG. 1 shows a sketch of a cross-section of an embodiment variant of a combustion engine according to the invention.

FIG. 1 schematically shows a simplified cross-section through a part of the crankcase 1 of a combustion engine according to the invention. In the upper area, there is situated the piston group 2 having two cylinders that are schematically depicted. The crank cavity 3 constitutes the lower part of the crankcase 1 and shows the crankshaft 3, which would extend beyond the figure or the figure plane, respectively, with the longitudinal axis thereof. Underneath the crank cavity there is situated the oil sump 5, wherein the solid area represents the oil reservoir 6. At the right side wall of the crank cavity 3, openings are visible. The inlet 7 and the outlet 8 may be in a multiple-arrangement along the crank cavity 3.

The depicted embodiment variant aims at discharging those oil droplet fractions, which are the most subject to degradation, together with the chemically reactive blow-by gases quickly out of the crankcase 1 and reducing the temperature around the oil drops in the engine compartment of the combustion engine. Arrows indicate fluid movements, which are relevant for the method according to the invention. The flushing of the oil droplets with cool air will reduce the surface reactions and the ageing rate of the oil. This is realized by cool fresh air being blown into the oil reservoir 6 at several position as close above the oil level as possible through the respective inlet 7. The inflow direction thus is tangential to the direction of movement of the crankshaft 4, so that the purging air will be supported and, fluidized by the movement of the crankpins between crankshaft 4 and oil reservoir sump 6, will flow from there up to the opposite side of the crank cavity 3. Finally, the airflow will be again discharged out of the crankcase 3 through the outlet 8, entraining the blow-by gases flowing out of the piston group 2 or the cylinder sleeves, respectively, into the crank cavity 3.

The exiting mixture of oil droplets, purging air and blow-by gas is moved directly from the outlet 8 to an oil separator 9. A continuously inclined connection of the outlet 8 with the oil separator 9 is indicated in FIG. 1 by dashed lines. In the oil separator 9, the oil is separated and supplied to a waste oil container (not illustrated) via the oil outlet 15. The gas, from which waste oil has been removed, is returned to the suction pipe of the combustion engine via a gas pipe (16). By means of the method according to the invention, the oil discharged from the oil outlet 8 is mainly lubricating oil, which is more subject to degradation than the oil in the oil sump. According to the invention, hence, there is made the provision that the partial amount of oil discharged will not be reused. The oil discharged from the combustion engine in total is replaced by fresh oil from a not-depicted fresh oil container by means of the automatic refilling device.

Figure 2:
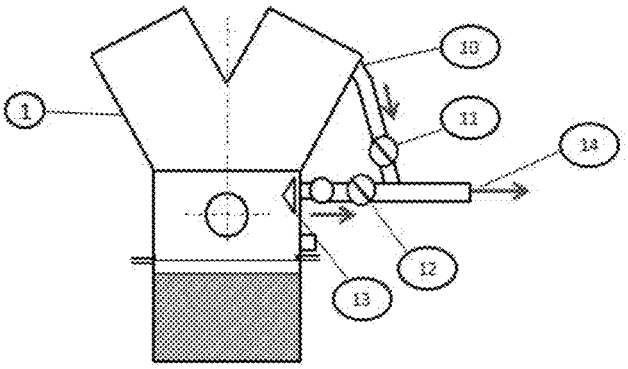
FIG. 2 shows a sketch of a cross-section of an embodiment variant of a combustion engine according to the invention.

FIG. 2 shows some further details of an embodiment variant of a combustion engine according to the invention. The illustration of the crankcase 1 corresponds to the one in FIG. 1, wherein the illustration of already discussed elements and the reference numbers for a better understanding thereof have been omitted.

At the upper end of the crankcase 1, a partial flow is removed at a further outlet 10 of the crankcase gas. This partial flow is connected with the airflow from the first outlet 8 via an adjustable throttle 11. A throttle device 12 is preferably installed also for the airflow from the outlet 8. The gas exiting at the upper and slow-flow end of the crankcase (further outlet 10) has a significantly lower oil load than the gas exiting laterally at the crank cavity (outlet 8). Due to appropriate positions of the throttle components, the mixed gas 14 composed of the two partial flows may be adjusted to the desired oil load. In order to prevent that large oil drops or splash oil portions are entrained with this laterally exiting gas, there are provided the appropriate selecting devices such as, e.g., a cyclone-like droplet separator 13.

Figure 3:
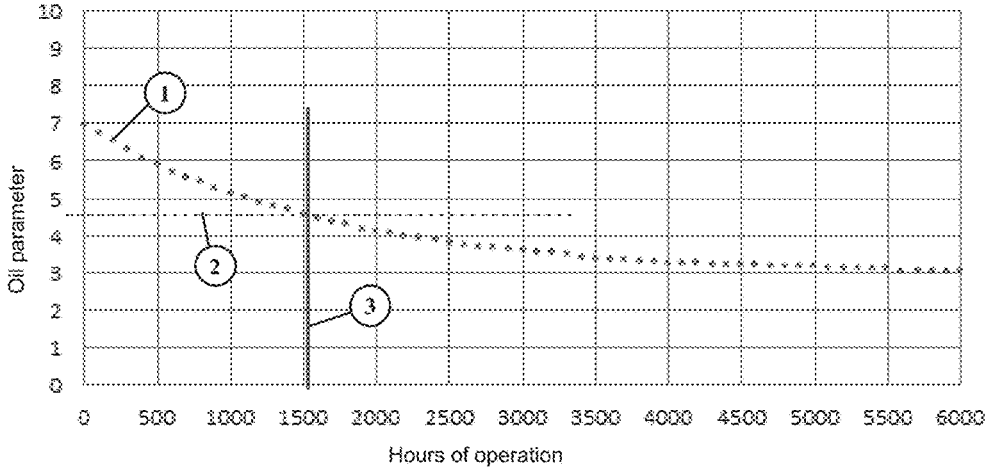
FIG. 3 shows a chart of the course of limiting oil parameter in full load operation without application of a method according to the invention.
Figure 4:
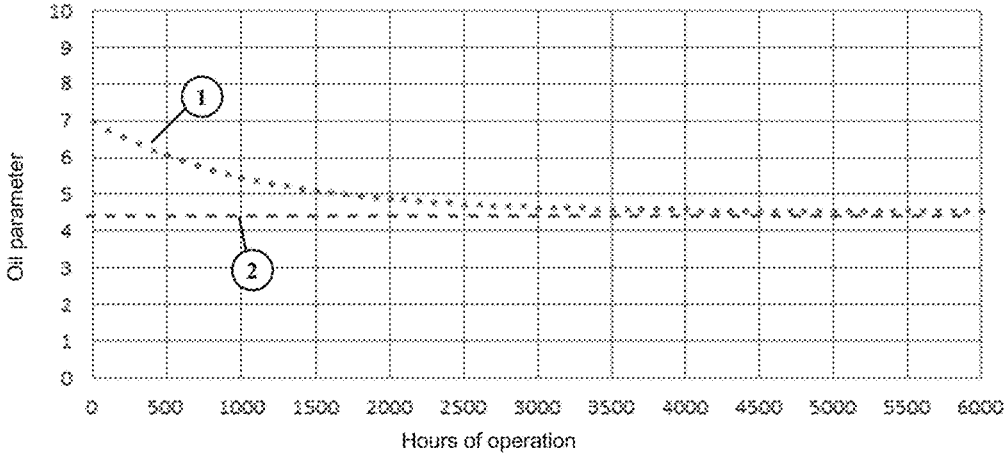
FIG. 4 shows a chart of the course of limiting oil parameter in full load operation with application of a method according to the invention.

The FIGS. 3 and 4 show charts regarding the temporal course of an oil parameter according to the state of the art in practice (FIG. 3) as well as upon application of the method according to the invention (FIG. 4).

The dotted line 1 indicates the respective value of a relevant quality parameter, for example, derived from viscosity, total base number (TBN), total acid number (TAN), oxidation and nitration. For the oil parameter used applies that higher values represent a higher quality of the oil. At the start of operation, the oil parameter has the value of 8, then dropping over the full load operation. The tolerance range for the oil parameter is indicated by the lower threshold value of 4.5, which is depicted in the figure by the dashed line 2. In FIG. 3, the oil parameter lies under this limit after 1,500 hours of operation, as depicted by the horizontal line 3. For this reason, for a corresponding engine there has to be performed an oil change after 1,500 hours of service life. FIG. 4 shows that in operation with a method according to the invention, however, the value will not drop below the threshold value. The values for the oil parameter remain well above the threshold value, as indicated by line 1. Data relate to an oil discharge of 0.05 g/kWh in addition to a specific oil consumption of 0.15 g/kWh.

The situations depicted in FIGS. 3 and 4 relate, for example, to a stationary combustion engine, which upon standard application exhibits the following features:

| | |
|---|---|
| Engine performance. | 1000 kW |
| Specific lubricating oil consumption: | 0.15 g/kWh |
| Oil sump content: | 300 l |
| Oil service life: | 1500 hrs of operation |
| Suction air amount: | 4,110 $m^3/h$ |
| Blow-by volume flow: | 26 $m^3/h$ |
| Oil load in the blow-by: | 11.7 g/h |

The saving potential as a result of the method according to the invention is to be illustrated by way of concrete numbers in a simplified way. In normal operation, within an oil service life of 1,500 hours of operation, the engine will have a consumption of 225 kg oil. The amount of oil, which is entrained in the blow-by within this period, corresponds to about 18 kg. On the occasion of an oil change, about 220 kg oil have to be disposed of.

In order to reach a constant oil quality near the limit of usability, by way of an additional oil discharge according to the invention, there have to be discharged, for example, in addition 0.05 g/kWh with an airflow. In this way, there may be reached, as shown in FIG. 4, a stable equilibrium of the oil quality within the acceptable threshold values. The maximum oil load possible of the purging air with an oil droplet fraction of less than about 10 μm amounts to about 1.0 $g/m^3$; accordingly, the airflow has to have a purging air amount of about 50 $m^3/h$, which corresponds more or less to the double of the blow-by volume flow.

Over a course of 6,000 hours of operation, according to prior art, there has to be performed an oil change four times, so that four times the oil sump content, i.e. 1,200 l, have to be provided, in contrast to which, over a course of 6,000 hours of operation according to the method proposed, only a refill amount of fresh oil of about 400 l will be required. Compared to the oil change, the oil costs for providing usable oil will be reduced to one third.

Positive for the cost-effectiveness will also be the omission of downtime and the reduction of the waste oil to be disposed of, wherein the aspect last mentioned also has to be considered an advantage due to environmental reasons.

The invention claimed is:

1. A method for operating a combustion engine having a crankcase, a piston group and a crankshaft, wherein the crankcase has an oil reservoir and an operational amount of lubricating oil is provided, the method comprising:

i) continuously discharging a partial amount of the lubricating oil from the crankcase; and ii) supplying a refill amount of new lubricating oil to the crankcase, wherein the operational amount of lubricating oil remains essentially the same, wherein an airflow is moved via an inlet into the crankcase and moved via an outlet out of the crankcase, wherein the airflow is moved in the crankcase so that it is diverted about a rotational axis of the crankshaft in a corresponding rotational direction of the crankshaft, wherein, for this purpose, the inlet is arranged underneath a height of the crankshaft on one side of the crankcase and the outlet is arranged above the height of the crankshaft on a same side of the crankcase.

2. A method according to claim 1, wherein the partial amount of the lubricating oil that is discharged is selected so that the lubricating oil of the operational amount in total lies within a tolerance range of a quality parameter, wherein the partial amount discharged lies outside of the tolerance range of the quality parameter.

3. A method according to claim 2, wherein the quality parameter is selected from the group consisting of viscosity, TBN (total base number), TAN (total acid number), oxidation and nitration.

4. A method according to claim 3, wherein the amount of lubricating oil that is discharged is present in the airflow vented as an oil drop fraction, wherein the droplets have a diameter of less than 0.2 mm.

5. A method according to claim 1, wherein the airflow loaded with an oil drop fraction is mixed with a further airflow from the crankcase, wherein the further airflow differs from the loaded airflow by a smaller oil load.

6. A method according to claim 1, wherein a gas portion, which flows into the crankcase via the piston group (blow-by gas), will be discharged with the airflow.

7. A method for operating a combustion engine having a crankcase, a piston group and a crankshaft, wherein the crankcase has an oil reservoir and an operational amount of lubricating oil is provided, the method comprising:

i) continuously discharging a partial amount of the lubricating oil from the crankcase by means of airflow moving via an inlet into the crankcase and moving via an outlet out of the crankcase;

ii) supplying a refill amount of new lubricating oil to the crankcase; and iii) discarding the partial amount of the lubricating oil discharged from the crankcase, wherein the operational amount of lubricating oil remains essentially the same.

8. A method according to claim 7, wherein discarding the partial amount of the lubricating oil discharged from the crankcase includes conducting to a waste oil container.

* * * * *